US005230422A

United States Patent [19]

Karweik et al.

[11] Patent Number: 5,230,422

[45] Date of Patent: Jul. 27, 1993

[54] OPERATOR/CARTRIDGE ASSEMBLY

[75] Inventors: Roger E. Karweik, Milwaukee; Gary C. Fillus, South Milwaukee; Thomas G. Karakis, Greendale, all of Wis.

[73] Assignee: Allen-Bradley Company, Inc., Milwaukee, Wis.

[21] Appl. No.: 609,292

[22] Filed: Nov. 5, 1990

[51] Int. Cl.[5] ..... H01H 9/08

[52] U.S. Cl. ..... 200/307; 200/5 R; 200/295; 174/61; 361/417

[58] Field of Search ..... 200/293, 296, 307, 294, 200/295, 303, 5 R, 5 B; 361/331, 332, 346, 393, 394, 396, 417, 419, 422; 174/54, 61

[56] References Cited

U.S. PATENT DOCUMENTS

| | | | |
|---|---|---|---|
| 2,984,726 | 5/1961 | Roeser | 200/302.2 |
| 3,213,189 | 10/1965 | Mitchell et al. | 200/295 X |
| 3,236,975 | 2/1966 | De Smidt et al. | 337/201 |
| 3,676,630 | 7/1972 | Dennison | 200/295 |
| 3,770,925 | 11/1973 | Nelson et al. | 200/296 |
| 3,917,921 | 11/1975 | Jakubauskas | 200/293 X |
| 4,064,381 | 12/1977 | Mullen et al. | 220/307 X |
| 4,139,755 | 2/1979 | Hastings et al. | 200/295 |
| 4,157,463 | 6/1979 | Fujita | 200/307 |
| 4,180,712 | 12/1979 | Lutzenberger et al. | 200/303 X |
| 4,211,905 | 7/1980 | Quigley | 200/295 |
| 4,220,808 | 9/1980 | Fujita | 174/48 |
| 4,250,368 | 2/1981 | Johnston et al. | 200/307 |
| 4,306,123 | 12/1981 | Taylor | 200/307 X |
| 4,315,123 | 2/1982 | Fujita | 200/307 |
| 4,340,795 | 7/1982 | Arthur | 200/295 |
| 4,398,073 | 8/1983 | Botz et al. | 200/296 X |
| 4,405,843 | 9/1983 | Wolniak et al. | 200/43.08 |
| 4,704,659 | 11/1987 | Heng et al. | 200/307 X |
| 4,883,929 | 11/1989 | Shinohara et al. | 200/296 |
| 4,988,553 | 1/1991 | Saiki et al. | 200/295 X |
| 5,041,706 | 8/1991 | Osika et al. | 200/295 X |

FOREIGN PATENT DOCUMENTS

| | | | |
|---|---|---|---|
| 1125824 | 6/1982 | Canada | 200/307 |
| 2149365 | 4/1972 | Fed. Rep. of Germany | 200/307 |
| 2701046 | 7/1978 | Fed. Rep. of Germany | 200/307 |
| 2199992 | 7/1988 | United Kingdom | 200/295 |

OTHER PUBLICATIONS

Exhibit Nos. 1.1-1.11, eleven photographs showing Klockner-Moeller EK01 cartridge and latch (no date). Exhibit Nos 2.1-2.9, nine photographs showing Rafi cartridge and latch (no date).

*Primary Examiner*—Henry J. Recla
*Assistant Examiner*—Glenn T. Barrett

[57] ABSTRACT

A switch operator, such as a manual push button, mounts a latch onto which are mounted up to four cartridges. A pair of laterally opposed arms of the latch receive each cartridge between them, and lock the cartridge to the latch. Each cartridge has four lips, two for each arm, which engage a pair of spaced apart locking surfaces on each arm. Each arm fits between the two lips it engages, and each cartridge has a pair of feet which fit into a pair of pockets in the latch. A contact cartridge has a follower, and the follower and feet are both positioned to one side of the cartridge, and the feet cooperate with the pockets to insure proper orientation of the cartridge in its position on the latch.

16 Claims, 6 Drawing Sheets

OPERATOR/CARTRIDGE ASSEMBLY

BACKGROUND OF THE INVENTION

1. Field of the Invention

The invention relates to operator/cartridge assemblies generally, and particularly to a latching interface for assembling a contact cartridge or other type of cartridge to a switch operator or other operator.

2. Discussion of the Prior Art

Contact cartridges for use in manually operated push-button switches and other electrical circuit operating elements are well known. These cartridges are typically generally parallelepiped shaped and house a set of normally open or normally closed electrical contacts. A spring biased follower carries an electrically conductive contact bridging element and extends outside of the housing of the cartridge. Depressing the follower either opens the electrical circuit made by the contacts, in a normally closed contact cartridge, or closes the circuit, in a normally open contact cartridge.

One or more of these contact cartridges is usually assembled to a manually operated switch or other operator (e.g., a solenoid) so as to allow convenient operation of the follower. It is often desirable to provide as many contact cartridges as possible on these operators so as to operate several electrical circuits with each operator. However, space limitations have generally made only two or three cartridges possible.

It is also desirable to make these cartridges as easy as possible to assemble to their operators. The cartridges are often purchased separately and assembled to their operators under maintenance or "in service" conditions in the field. The portion of the operator that mounts the cartridges typically resides behind an operating panel, and can be inaccessible and in very close quarters, making it difficult to assemble the cartridge to the operator. Also, the interface between the cartridge and the operator should be exclusive, i.e., such that the cartridge can only be assembled to the operator in the proper orientation and positively and securely locked into place.

It is typical to use a snap action locking interface between the cartridge and the operator. In one known construction, a lip of the cartridge is hooked under a ledge of a latch on the operator and the cartridge is pivoted toward the latch until a ledge of the cartridge on the opposite side from the lip snaps under an arm of the latch. In another known construction, a contact cartridge is guided by the latch along a translatory path until biased arms at the ends of the cartridge snap into recesses formed by the latch. In these constructions, if there is insufficient clearance or accessibility to rock the cartridge into place in the formerly mentioned design, or to translate the cartridge into place in the latter design, assembly can be very difficult.

In known switch assemblies having only two or three contact cartridges, the cartridges have typically been made with a transversely symmetrical latching interface and/or follower, and any cartridge could be placed in any position. However, when four cartridges are provided in a single switch assembly, a special problem arises so that following the prior art design of a transversely symmetrical interface and/or follower results in the switches being specialized for particular positions. This in turn would result in an excessive number of different parts, and corresponding problems in ordering, supply, and inventory control, and increased tooling and other capital costs to manufacture the cartridges.

SUMMARY OF THE INVENTION

The invention provides an operator/cartridge assembly having an operator defined along mutually perpendicular longitudinal, lateral and transverse directions. A latch is provided on the operator having a foundation and a pair of laterally opposed and spaced apart arms. Each arm extends from a fixed end rearwardly along the longitudinal direction from the foundation to a free end, and the arms are resilient toward and away from one another in the lateral direction. The free end of each arm defines a locking surface which includes a forwardly facing nose surface extending outwardly from an inner free edge to an outer edge and a forwardly facing cam surface inclined outwardly from an inner edge which intersects the outer edge of the nose surface to an outer edge. A cartridge for the assembly has a pair of laterally opposed outwardly extending lips. Each lip defines a rearwardly facing ledge surface for engagement with the locking surface on the corresponding lateral side of the latch. The lips are registrable with the locking surfaces forwardly of the nose surfaces and the cartridge is biased forwardly against the foundation by the lips camming on the cam surface. With this construction, the cartridge can be either rocked or translated into position, subject only to the preference of the assembler.

In a preferred form, the free end of each arm has a pair of transversely spaced apart locking surfaces and each lateral side of the cartridge has a pair of spaced apart lips, one for engaging each locking surface on the arm. Each arm can extend inwardly from the cam surface in the space between the locking surfaces of each free end to be received in the space between the corresponding lips of the cartridge engaged by the arm. The arms fitting into these spaces help provide lateral stability to the connection between the latch and the cartridge.

The foundation preferably defines a rearwardly opening pocket to receive a foot of the cartridge. Two pockets and two corresponding feet are preferably provided for each cartridge position. The feet fitting into the pockets and the arms fitting between the lips cooperate to react against transverse forces which may otherwise upset the connection between the cartridge and the latch. The feet fitting into the pockets also provide additional guidance during assembly. In addition, the feet and pockets may be made to interfit so as to impede moving the cartridge laterally when it is assembled to the latch.

In an especially useful form, the feet are provided off-center from the transverse center plane of the cartridge, and the pockets are so positioned in the foundation to receive the feet. In this form, the cartridge can advantageously be a switch cartridge having a longitudinally extending reciprocable follower, and the follower is also positioned off center from the transverse center plane of the cartridge, preferably to the same side as the feet. Thereby, the followers of adjacent switches can be positioned closely adjacent to one another simply by orienting adjacent switches 180° relative to one another. This positions all four followers of four cartridges assembled to the latch toward the outside of the operator, and is especially useful when the central bore of the operator must be kept open, for example to accommodate ah illumination cartridge.

In another useful aspect, each free end has a pair of transversely spaced apart rearwardly facing ramp surfaces which cam on the lips as the cartridge is engaged with the latch. Each arm extends inwardly toward the laterally opposite arm in the space between the two ramp surfaces so as to fit between the lips and thereby guide the lips into subsequent engagement with the locking surfaces.

In another form, the latch can be provided with a body portion between the operator and the foundation, for example to house a transformer or other desired electrical device. A push rod can be provided through the body for each cartridge mounting position, so as to translate the motion of the operator to actuate the follower of the cartridge.

BRIEF DESCRIPTIONS OF THE DRAWINGS

DETAILED DESCRIPTION OF THE PREFERRED EMBODIMENTS

Figure 1:
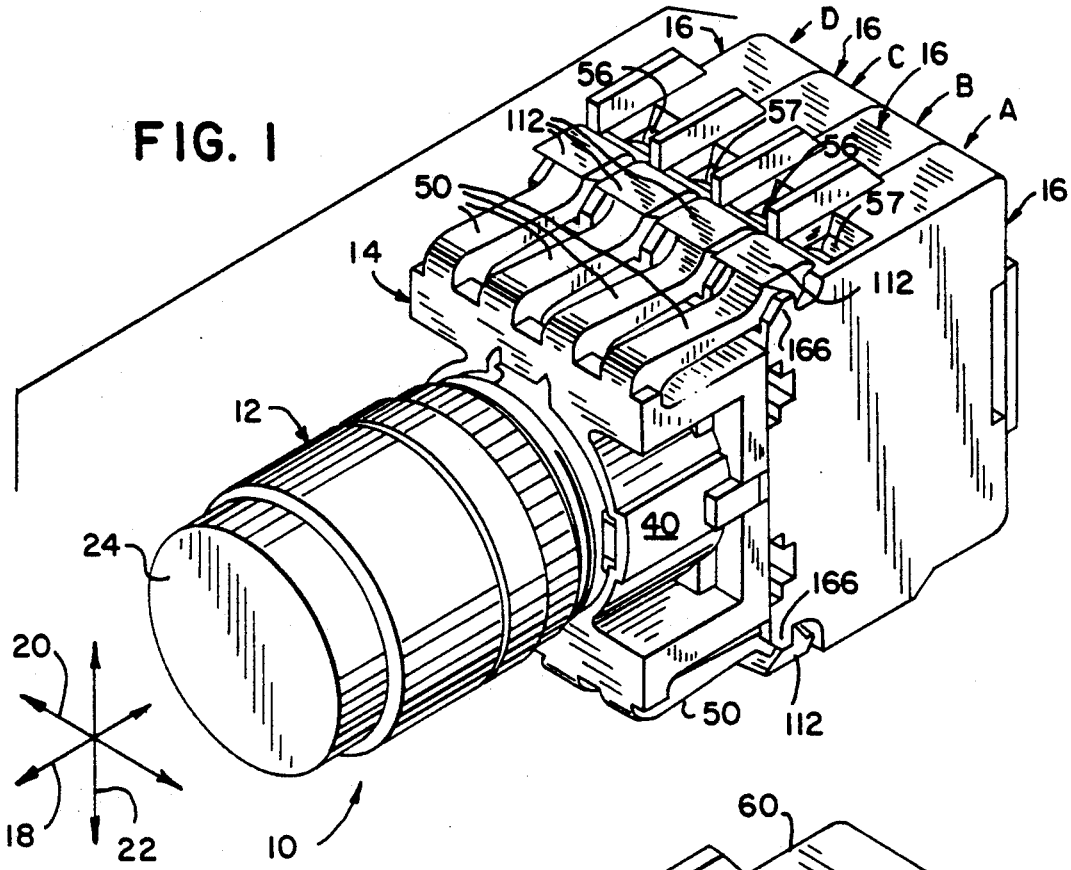
FIG. 1 is a schematic perspective view of an operator/cartridge assembly of the invention.

Referring to FIG. 1 an operator/cartridge assembly 10 of the invention is disclosed. The operator/cartridge assembly 10 includes a switch operator 12, a latch 14 on the switch operator 12 and four identical contact cartridges 16, each at a position A, B, C or D. The assembly 10 extends fore and aft from the switch operator 12 to the cartridges 16 in a longitudinal direction 18. The cartridges 16 are stacked along a transverse direction 20 and extend vertically as shown in FIG. 1 along a lateral direction 22. As shown in FIG. 1, the operator 12 is at the front of the assembly 10 and the cartridges 16 are at the rear.

Figures 2, 13A, 13B:
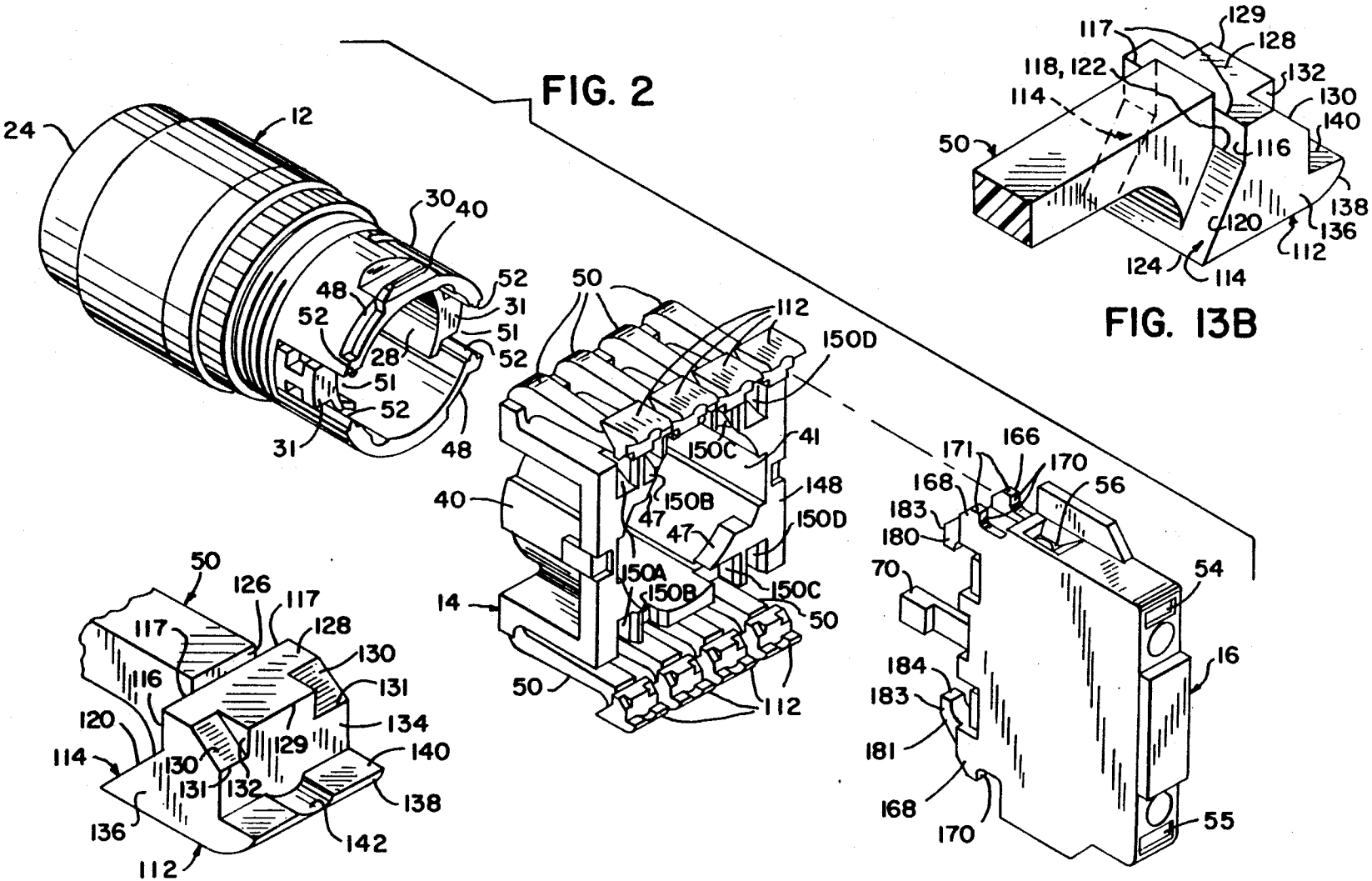
FIG. 2 is an exploded schematic perspective view of the operator/cartridge assembly of FIG. 2.
FIG. 13A is a detail front perspective view of the free end of an arm of the latch.
FIG. 13B is a detail rear perspective view of the free end of an arm of the latch.

Referring to FIG. 2, it can be seen that in the preferred embodiment of the assembly 10, the switch operator 12, the latch 14 and the contact cartridges 16 are the three main discrete components. The switch operator 12 is generally barrel-shaped and has a pushbutton 24 which is manually operable by a user. The pushbutton 24 may be made of a transparent material and, as shown in FIG. 3, the assembly be provided with a lens 25, in case the operator 12 is illuminated.

Figures 3, 14, 15:
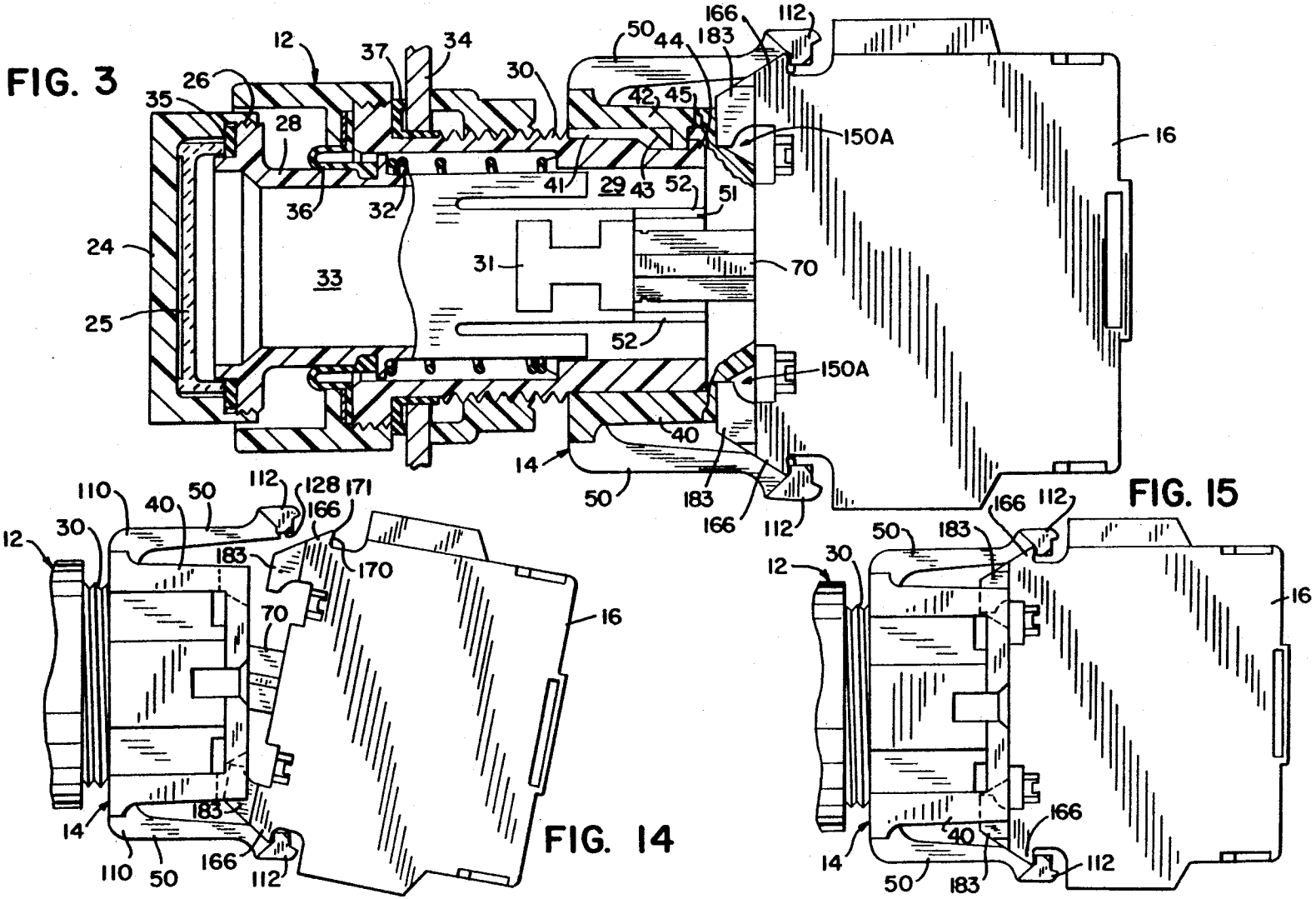
FIG. 3 is a side view of the operator/cartridge assembly of FIG. 1 with portions broken away.
FIG. 14 is a side elevation view illustrating a contact cartridge being assembled to the latch according to one preferred method of assembly.
FIG. 15 is a side elevation view of the latch with the contact cartridge assembled to the latch.

In any event, the pushbutton 24 is secured by any suitable means such as the threads 26 shown in FIG. 3 to an axially reciprocable pusher 28 which is received in bore 29 of operator housing 30. The pusher 28 is biased forwardly by spring 32 to its "at rest" position shown in FIG. 3. In this position, transversely opposed transverse projections 31 at the rear end of the pusher 28 extend into and ride in slots 51 in an operator housing 30. The pusher 28 is prevented from being ejected forwardly out of the housing 30 under the bias of the spring 32 by the transverse projections 31 bottoming against the forward ends of the slots 51.

The operator housing 30 is typically mounted in an operating panel 34 (FIG. 3) with the pushbutton 24 forward of the panel 34 and the housing 30 extending rearwardly from the panel 34. Appropriate seals such as 35, 36 and 37 are provided to sufficiently seal off the interior of the operator 12 from the operating environment forward of the operating panel 34. It should be noted that although the particular pushbutton operator 12 has been described in some detail, the present invention could be practiced with any suitable operator, whether a pushbutton operator or another type of actuator, or merely a lens. Any type of component useful for mounting or supporting a latch such as the latch 14 and cartridges such as cartridges 16 may be used to practice the invention.

The latch 14 is mounted on the rear portion of the operator housing 30, typically behind the operating panel 34, and is secured thereon with a snap action connection. It should be noted that the connection between the latch 14 and the operator 12 could be made in any suitable way to practice the present invention. For example, the latch 14 could be made integral with the housing 30, or could be screwed on or otherwise securely fastened to the operator 12 such as for example using intermediate components.

In the preferred embodiment of the latch 14 and operator 12 shown in FIGS. 1–4, the latch 14 has a foundation 40 through which a bore 41 extends. The bore 41 is shaped to fit over the rear portion of the operator housing 30. A snap action leg 42 provided with one or more ramp surfaces 43 is cammed outwardly as the latch 14 is slid over the housing 30 and snaps behind lip 44 of the housing 30 when rearward facing ledge 45 of leg 42 clears the lip 44. Thereby, the latch 14 is locked onto the housing 30 and cannot be removed rearwardly therefrom without first disengaging the leg 42.

The latch 14 is prevented from further forward motion longitudinally relative to the housing 30 by suitable stops 47 (FIGS. 2 and 4) provided on the latch 14 extending into the bore 41 which fit into and bottom in similarly shaped recesses 48 formed in the end of the housing 30. Note that the latch 14 can be assembled to the operator housing 30 in only one angular orientation because of the mating shape (FIG. 4) of the housing 30 and bore 41. In this orientation as shown in FIGS. 1 and 2, the transverse projections 31 of the pusher 28 are opposed and spaced apart from one another along the transverse direction 20 and the arms 50 on the top of the latch 14 are opposed and spaced apart from the arms 50 on the bottom of the latch 14 along the lateral direction 22. Thus, in the assembly, the transverse projections 31 of the pusher 28 are halfway between the pairs of laterally opposed arms 50 along the lateral direction. Note that the pusher 28 remains oriented angularly within the housing 30 and therefore relative to the latch 14 since transverse projections 31 extend into slots 51 in the housing 30 and freely slide against ribs 52 of the housing 30 in the slots 51.

Figure 5:
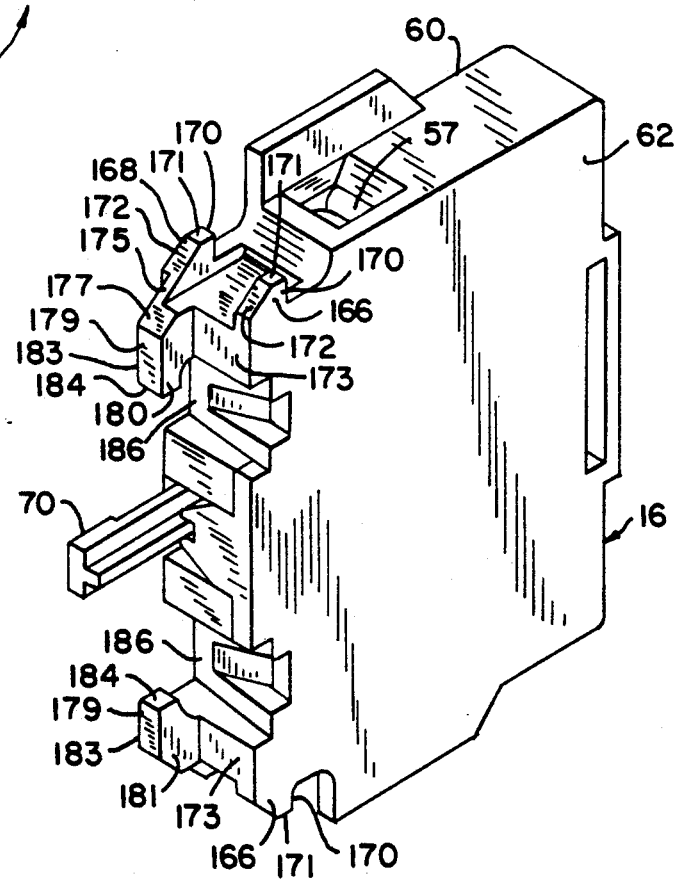
FIG. 5 is a perspective view of a contact cartridge for the operator/cartridge assembly of FIG. 1.
Figure 6:
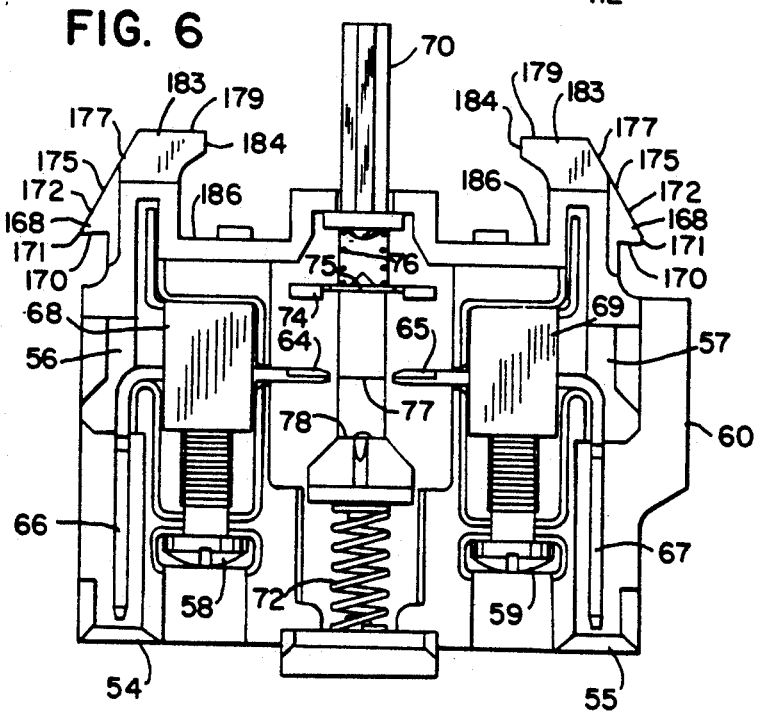
FIG. 6 is a side view of the contact cartridge of FIG. 5 with a cover removed.

The cartridges 16 shown in FIGS. 1-3 and 5-7 are contact cartridges, i.e., they are actually individual switches capable of making (in a normally open switch) or breaking (in a normally closed switch) a pair of electrical contacts. The particular contact cartridge 16 disclosed includes a plastic molded base 60 and a plastic molded cover 62 which are snapped, adhered or otherwise suitably secured together. As one illustrative embodiment, FIG. 6 shows a contact cartridge 16 incorporating an interface of the invention with the cover 62 removed to reveal the various other components of the cartridge. As shown in FIG. 6, the cartridge 16 has a pair of electrical contacts 64 and 65 which are connectable to exterior wiring by suitable stab connectors 66 and 67, respectively, which are formed of the same strip of metal as the corresponding contact 64 or 65, or by compression connectors 68 and 69, respectively. The stab connectors 66 and 67 are accessible from the exterior of the cartridge 16 through respective recesses 54 and 55 in the rear wall of the cartridge 16, to be received within conventional female stab connectors (not shown). The compression connectors 64 and 65 are accessible through recesses 56 and 57 in the opposing lateral side walls of the cartridge 16. The end of a conductor (not shown) is inserted through one of the recesses 56 and 57 and into the corresponding compression connector 68 or 69. The respective screw 58 or 59 of the corresponding compression connector 68 or 69 is then tightened to clamp the end of the conductor against the corresponding contact 64 or 65 thereby making the desired connection.

Each cartridge 16 also includes a longitudinally reciprocable follower 70 which is biased outwardly by a spring 72 and carries with it an electrical contact bridge 74, which is held against a wall 75 of the follower 70 by an overtravel spring 76. Note that as assembled in FIG. 6, the contact cartridge 16 is normally open. The same cartridge could be made normally closed by assembling the electrical contact bridge 74 against wall 77 with the overtravel spring 76 extending between the electrical contact bridge 74 and wall 78 of the follower 70.

Although the cartridge 16 of the preferred embodiment has been described in some detail, it should be noted that the invention does not require a contact cartridge of the specific type described. Indeed, although the invention is particularly well suited for use with contact cartridges, it could be applied to other types of cartridges that do not provide electrical contacts or a switch at all, such as illumination cartridges as described below.

The cartridge 16 is generally parallelepiped shaped, being relatively thin in the transverse direction relative to its dimensions in the longitudinal and lateral directions. The thin transverse dimension is desirable so as to provide space for stacking four cartridges adjacent to one another in the transverse direction. The space available in operator cartridge assemblies is typically very limited, although it is desirable to have as many cartridges as possible in that space.

Figure 7:
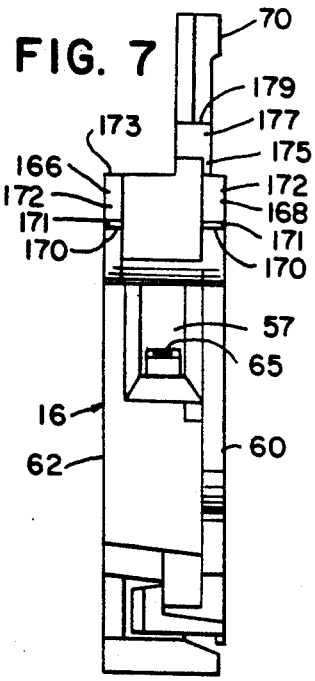
FIG. 7 is a top view of the contact cartridge of FIG. 5.

Referring particularly to FIGS. 2, 5 and 7, the follower 70 of the contact cartridge 16 is preferably arranged along one side of the cartridge 16. It is purposely arranged off-center to one side of the transverse center of the cartridge 16 so that adjacent cartridges on the ends of the assembly, i.e., the two right cartridges in FIG. 1 at positions A and B, and the two left cartridges in FIG. 1 at positions C and D, can be oriented relative to one another so as to minimize the transverse distance between the followers 70 of the two adjacent cartridges 16. Thus, both followers 70 of the two end cartridges at positions A and B or C and D can be positioned over the corresponding one of the transverse projections 31 of the pusher 28 so that each transverse projection 31 can bear against two followers 70.

FIG. 3 shows a transverse projection 31 bearing against a follower 70, it being understood that the projection 31 could bear against another follower directly behind the follower 70 shown in FIG. 3. Thus, the two end cartridges 16 at positions A and B or at positions C and D are oriented 180° relative to one another (rotated about the longitudinal direction) with their bases 60 adjacent to one another and their covers 62 toward the outside.

Figure 4:
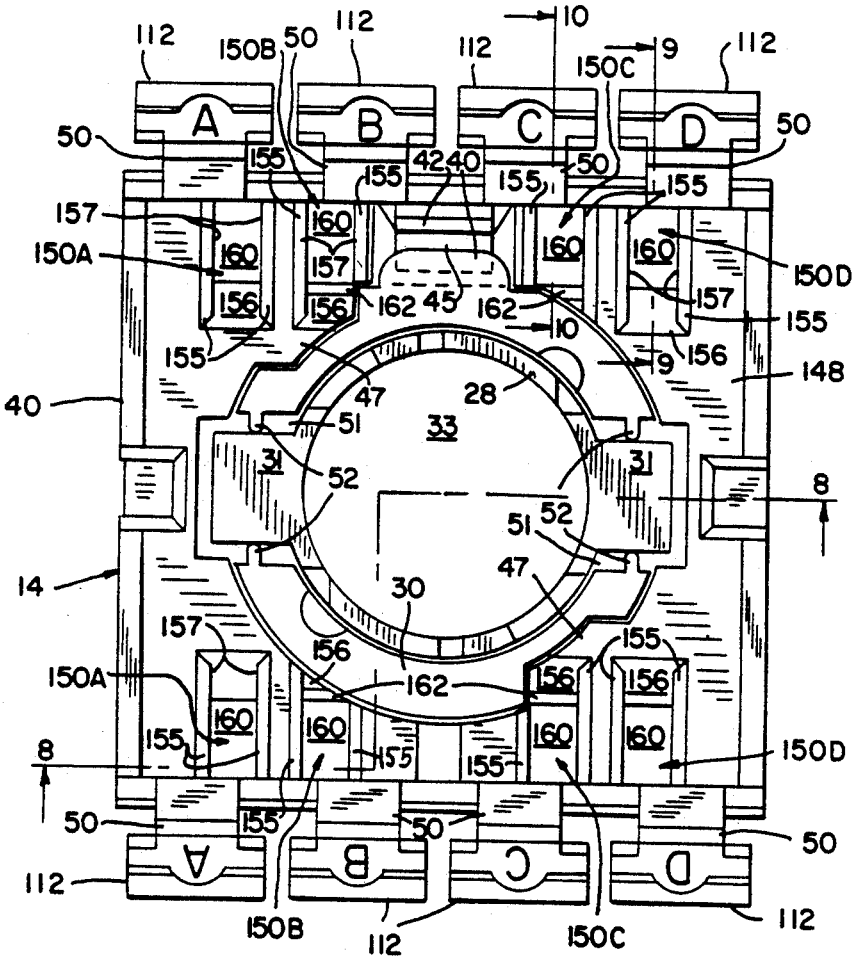
FIG. 4 is a rear elevation view of the latch and push button operator of FIG. 1 with the contact cartridges removed.
Figure 16:
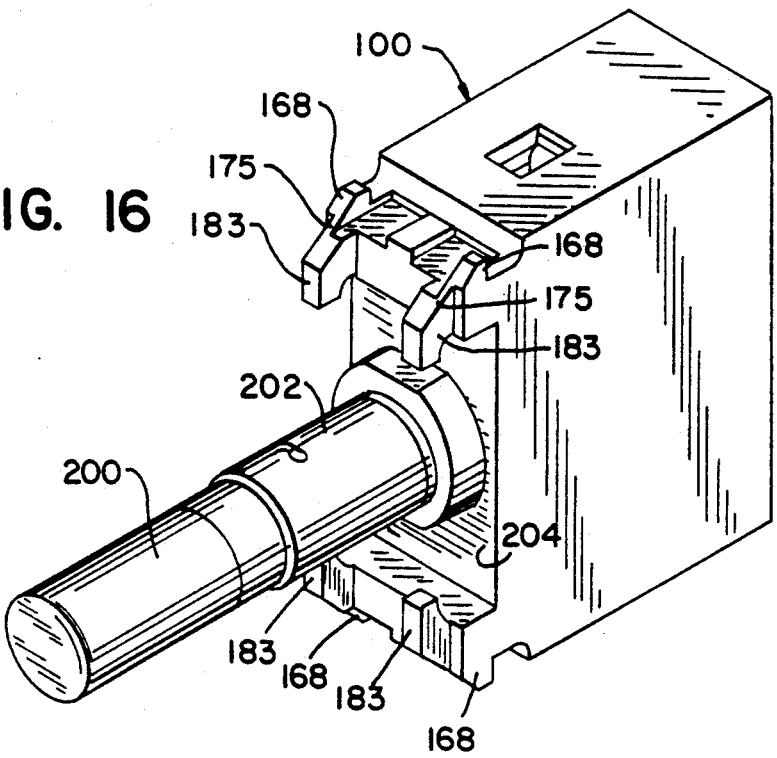
FIG. 16 is a perspective view of an alternate embodiment of a cartridge incorporating aspects of the invention.

It is desirable to have an open central lumen 33 of the operator 12 as shown in FIGS. 2 and 4. Positioning the followers 70 next to each other at positions A and B and at positions C and D facilitates this. The reason to keep the lumen 33 open is to provide the capability in the operator 12 to accommodate a light bulb in the central lumen 33, such as of an illumination module 100 as shown in FIG. 16, so as to provide an illuminated operator 12.

As previously mentioned, the latch 14 has a foundation 40 and four arms 50 transversely spaced apart and adjacent to one another along each lateral side (i.e., four arms 50 along each top and four arms 50 along each bottom side as shown in FIG. 1) of the foundation. One pair of laterally opposed arms 50 is provided for each position A, B, C and D. Each pair of laterally opposed arms 50 for each position has one arm 50 on the top lateral side and the other arm 50 on the bottom lateral side directly opposite from the top arm, and the two laterally opposed arms cooperate to hold each cartridge 16 between them in the corresponding position A, B, C or D. Thus, as viewed in FIG. 1, the pair of arms 50 at the right end of the foundation 40 hold a cartridge 16 in position A, the two laterally opposed arms 50 immediately on the right side of the transverse center of the foundation 40 hold a cartridge 16 in position B, the two laterally opposed arms 50 immediately on the left side of the transverse center of the foundation 40 hold a cartridge in position C, and the pair of laterally opposed arms 50 at the left end of the latch 14 hold a cartridge 16 in the position D. These positions are labelled on the arms 50 shown in FIG. 4.

Each arm 50 extends rearwardly from the foundation 40 in the longitudinal direction from a fixed end 110 to a free end 112. The arms 50 are integrally molded with the foundation 40 and are laterally resilient toward and away from the cartridges 16 that they hold. It is therefore preferable to mold the latch 14 of a resilient plastic material. In the preferred embodiment, the particular material used is a 30% glass filled polyester resin sold as Celanex TM 3311-2 T4682106 by Celanese Corporation, although many other materials having the requisite qualities of strength and resilience would suffice and are well known. The base 60 and cover 62 of the cartridge 16 may also be made of the same material.

As best shown in FIGS. 11, 12, 13A, and 13B, the free end 112 of each arm 50 defines two transversely spaced apart locking surfaces 114. Each arm 50 extends inwardly and forwardly from the locking surfaces 114 in the space between them.

Each locking surface 114 includes a forwardly facing nose surface 116 which extends outwardly from an inner free edge 117 to an outer edge 118. In the preferred embodiment, the nose surfaces 116 are in a plane which is generally perpendicular to the longitudinal direction 18. From the outer edge 118 of each nose surface 116, a forwardly facing cam surface 120 is inclined outwardly from an inner edge 122, which intersects the outer edge 118 of the nose surface 116, to an outer free edge 124.

The arm 50 extends forwardly and inwardly from both the nose surface 116 and the cam surface 120. As best shown in FIG. 13A, the arm 50 extending forwardly beyond the inner free edge 117 of the nose surface 116 defines a rearwardly facing ledge surface 126.

Extending rearwardly from the ledge surface 126 and from the inner free edges 117 of the nose surfaces 116 on each free end 112 is a T-shaped inwardly facing surface 128. Longitudinally opposite from each nose surface 116, a rearwardly facing ramp surface 130 angles outwardly and rearwardly from the rear edge of each arm of the T-shaped surface 128. This defines triangular shaped surfaces 132 between the longitudinal sides of the base of the T-shaped surface 128 and the ramp surfaces 130. Another T-shaped surface 134 is defined rearwardly facing in a plane substantially perpendicular to the longitudinal direction which intersects the rear transverse edge 129 of the T-shaped surface 128 and the rear transverse edges 131 of the ramp surfaces 130. The extreme transverse sides of the surface 134 also intersect an edge of each transverse side surface 136 of the free end 112.

The free end 112 extends rearwardly from the outside edge of the T-shaped surface 134 to define tab portion 138 having an inwardly facing surface 140 in a plane which is substantially perpendicular to the lateral direction 22. A recess 142 may be provided in the surface 140 to provide a bit more height on the surface 134 on which to emboss alphanumeric characters or other identifying indicia. For example, it may be desirable to stamp or mold the same character on each pair of laterally opposed arms 50 of each position A, B, C or D so as to identify the position, as shown in FIG. 4 where laterally opposed arms 50 are each identified with the same character identifying the position, either A, B, C or D.

Referring particularly to FIGS. 4, 8, 9 and 10, pairs of laterally opposed pockets 150A–D associated with each position A, B, C and D are formed in rearwardly facing surface 148 of the foundation 40. The pair of pockets 150A is associated with position A, the pair of pockets 150B is associated with position B, the pair of pockets 150C is associated with position C and the pair of pockets 150D is associated with position D.

Figure 8:
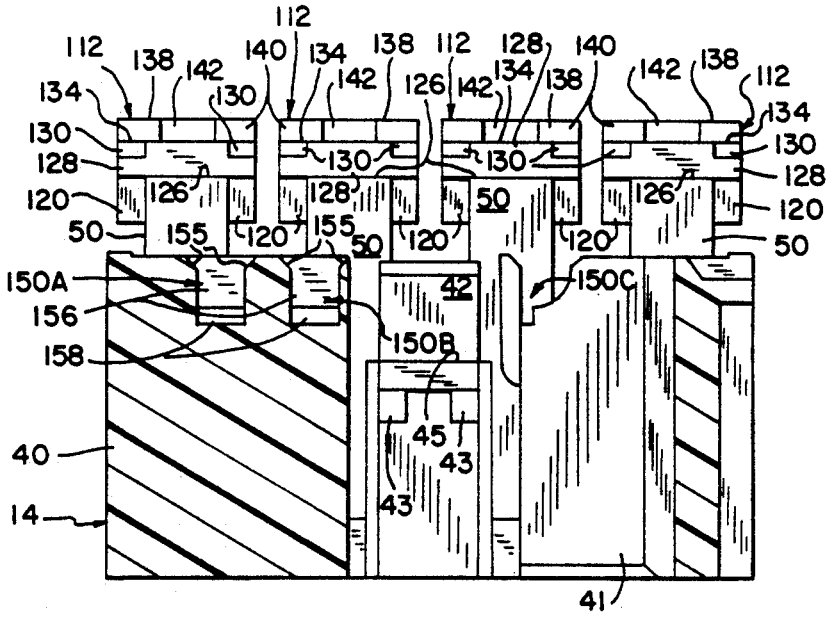
FIG. 8 is a sectional view of the latch alone taken along the line 8—8 of FIG. 4.
Figure 9:
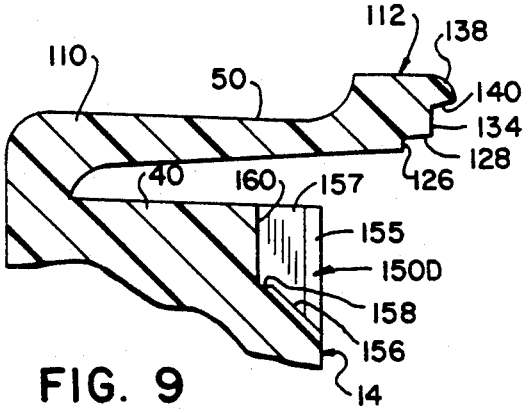
FIG. 9 is a fragmentary sectional view of the latch taken along the line 9—9 of FIG. 4.

The pockets 150A–D are substantially identical, but differ in minor regards depending on their position. Referring particularly to FIGS. 4, 8 and 9, the end pockets 150A and 150D are identical, and each has upper beveled side edges 155 and an inward ramp surface 156. The forward edge of the ramp surface 156 terminates at the rearward edge of an outwardly facing surface 158 which is in a plane that is substantially perpendicular to the lateral direction 22. A base surface 160 defines the forward extremity of each pocket 150A and 150D. Transversely spaced apart side surfaces 157 define the sides of the pockets 150A and 150D forward of the beveled edges 155, and the outer side of each pocket 150A and 150D is open.

Figure 10:
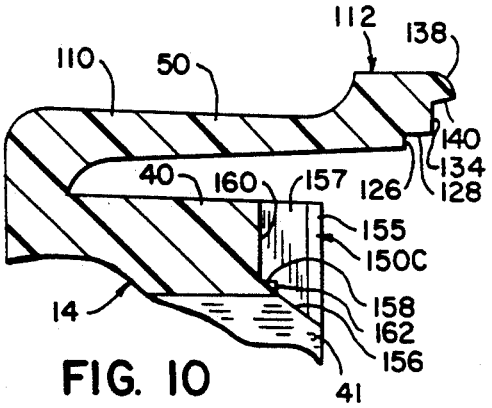
FIG. 10 is a fragmentary sectional view of the latch taken along the line 10—10 of FIG. 4.
Figure 11:
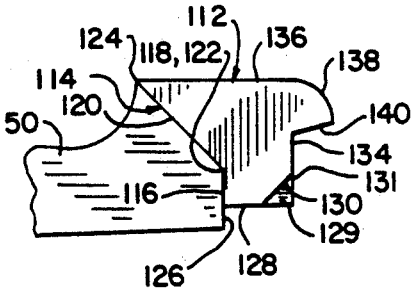
FIG. 11 is a detail side view of the free end of an arm of the latch.
Figure 12:
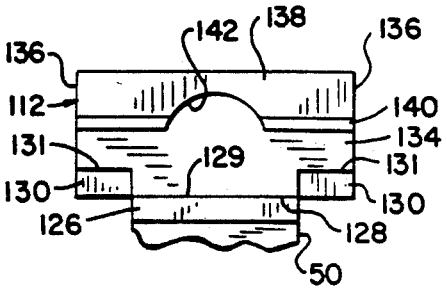
FIG. 12 is a detail rear elevation view of the free end of an arm of the latch.

The pockets 150B and 150C differ from the pockets 150A and 150D only in that portions of their inner surfaces are removed or strengthened because of the void created by the bore 41 of the foundation 40. Similar surfaces of the pockets 150B and 150C are labeled with references numbers corresponding to the corresponding surfaces of the pockets 150A and 150D. Referring to FIG. 10, it should be noted that the inward surfaces of the pockets 150B and 150C include an extra surface 162 which is in a plane perpendicular to the longitudinal direction 18. This surface 162 is created as a result of moving the forward edge of the ramp surface 156 inwardly toward the longitudinal axis. This provides additional plastic material for strengthening the wall 158. It should also be noted that each pocket 150B is the same as the diagonally opposed pocket 150C.

Referring now particularly to FIGS. 2 and 5, each cartridge 16 has two pairs of laterally opposed lips. One pair of lips, each of which is designated 166, is molded integrally with the cover 62, and the other pair of lips, each of which is designated 168, is molded integrally with the base 60. As shown in FIGS. 2 and 5, each set of lips 166 and 168 is positioned toward the forward end of the cartridge 16 and along the transversely spaced apart sides thereof.

Each lip 166 and 168 defines a rearwardly facing ledge surface 170 for engagement with a corresponding locking surface 114 of the free end 112 on the lateral side of the latch 14 at the position A, B, C or D thereof where the cartridge 16 is inserted. Thus, each free end 112 engages one lip 166 and one lip 168. In addition, each lip 166 and 168 has a laterally outwardly facing flat surface 171 and an inclined, forwardly facing cam surface 172. On the lips 166, the inclined cam surface 172 terminates at the forward surface 173 of the cartridge 16. For the lips 168, a bridging cam surface 175 extends from the cam surface 172 along the transversely inner side thereof to a foot cam surface 177. The foot cam surface 177 terminates at its forward edge in a pad surface 179 which is in a plane perpendicular to the longitudinal axis.

Side surfaces 180 and 181 together with the bridging cam surface 175 and the foot cam surface 177 define a foot 183 on each lateral side of the base 60. Each foot 183 has an inner surface 184 and recedes rearwardly from the inner surface 184 to intersect the forward surface 186 of the cartridge 16.

Referring now particularly to FIGS. 3, 14 and 15, two alternate preferred methods of assembling each cartridge 16 to the latch 14 will be described. In one method, the lips 166 and 168 along one lateral side of the cartridge 16 are hooked behind the corresponding nose surfaces 116 at the position A, B, C or D where the cartridge 16 is to be inserted and the cartridge is then pivoted or rocked as shown in FIG. 14 toward the latch 14. As the cartridge 16 is rocked toward the upper free end 112 as shown in FIG. 14, the triangular surfaces 132 of the free end 112 first engage between the lips 166 and 168 on the top side of the cartridge 16. As so engaged, the surfaces 132 initially guide the lips 166 and 168 to initially cam the bridging surface 175 and subsequently cam the cam surfaces 172 against ramp surfaces 130 of the free end 112.

As the surfaces on the free end 112 and the lips 166 and 168 are cammed against one another, the laterally opposed arms 50 at the position of the cartridge being inserted are spread apart against their bias until the cartridge 16 has been rocked to a position so that the free end 112 on the top of the latch as viewed in FIG. 14 snaps behind the lips 166 and 168. This occurs when the surfaces 171 of the lips 166 and 168 cam past the surface 128 and clear the free edges 117 of the nose surfaces 116.

Also, as the cartridge 16 is rocked into position, the feet 183 are directed into their corresponding pockets, for example into the pockets 150A at the A position, in the foundation to be received therein. The ramped inner surfaces 156 of the pockets allow sufficient clearance for rocking the feet 183 into them. Once both laterally opposed free ends 112 are locked behind their corresponding lips 166 and 168, the cam surfaces 120 of the locking surfaces 114 cam against the outer end corners (where the surfaces 170 and 171 meet) of the lips 166 and 168 to pull the cartridge 16 forwardly until the feet 183 bottom with their pad surfaces 179 abutting against the base surfaces 160 of the pockets, 150A, for example.

In an alternate method of assembly, the cartridge 16 is inserted into the latch 14 by generally aligning it between the free ends 112 at the position where it is to be inserted an translating the cartridge 16 forwardly along the longitudinal direction toward the latch 14. The foot cam surfaces 177 initially cam the cartridge 116 into alignment along the lateral direction between the arms 50 at the position A, B, C or D where the cartridge 16 is being inserted and the triangular surfaces 132 initially align the cartridge transversely relative to the arms 50. Further insertion of the cartridge 16 toward the latch 14 results in the cam surfaces 175, and subsequently the cam surfaces 172, simultaneously urging the opposed arms 50 laterally apart against their natural bias.

While the arms 50 are being urged apart, the feet 183 enter their corresponding pockets, for example 150A in the A position, to further help align the cartridge 16 into position. Further insertion results in the free ends 112 locking behind the lips 166 and 168 and the cam surfaces 120 pulling the cartridge 16 toward the latch 14 until the feet 183 bottom in their corresponding pockets, as described above.

This latching interface provides longitudinal, transverse and lateral stability. Longitudinally, each cartridge 16 cannot be moved closer to the latch 14 because the feet 183 of the cartridge are bottomed in their corresponding pockets 150A, 150B, 150C or 150D. The cartridge 16 cannot be pulled rearwardly out of the latch 14 without first releasing at least one arm 50, because the nose surfaces 116 will catch on the ledges 170 of the lips 166 and 168 if pulling the cartridge 16 away from the latch 14 without first releasing an arm 50 is attempted. Note that an arm can be released by grasping the tab portion 138 of the free end 112 and moving the free end outwardly until it clears the nose surfaces 116.

Stability in the transverse direction is provided by the feet 183 fitting into their corresponding pockets 150A, B, C or D and each arm 50 fitting in the space between the lips 166 and 168. If a force along the transverse direction is applied to the rear of one of the cartridges 116, the feet 183 will bear against the side walls 157 of the corresponding pockets 150A, B, C or D and the side walls 180 and 181 of the lips 166 and 168 will bear against the sides of the arms 50 in the spaces between the lips 166 and 168 to react against the transverse force to hold the cartridge 16 in position.

Lateral stability is provided by not only the bias and strength of the arms 50, but also by the feet 183 fitting within their corresponding pockets 150A, B, C or D. If a lateral (up and down as viewed in FIG. 1) force is applied to a cartridge 16, an inner surface 184 of one of the feet 183 will bear against one of the inner surfaces 158 of the corresponding pockets 150 A, B, C or D, to prevent lateral shifting of the cartridge while the cartridge is assembled to the latch 14.

It should be noted that the transverse positioning of each pair of pockets 150 A, B, C and D cooperates with the transverse positioning of each pair of laterally opposed arms 50 at the corresponding A, B, C and D positions to insure that each cartridge 16 can be assembled to the latch 14 in only one orientation in each position.

It should also be noted that the drawings are magnified. In the preferred embodiment, each cartridge is approximately 9/32 inches thick in the transverse direction, the latch is approximately 1-15/32 from the lateral outside of one free end 112 to the other, and the foundation is approximately 1-5/32 inches transversely across at its rear surface 148. These dimensions allow a small clearance between adjacent cartridges 16 when they are assembled to the latch 14. However, the invention is not limited to a cartridge and latch of any particular dimensions.

As mentioned above, the invention is not limited to using a contact cartridge, but could be used with other types of cartridges requiring assembly to latches. One such other type of cartridge is the illumination cartridge 100 shown in FIG. 16. The illumination cartridge 100 can be used with the latch 14 previously described. The illumination cartridge 100 requires the operator 12 to have an open central lumen 33 as described above to provide clearance for the lightbulb 200 and fixture 202 which extend forwardly from the cartridge 100. On the forward surface 204 of the cartridge 100 two pairs of lips 168, bridging surfaces 175 and feet 183 identical to the previously described lips 168, bridging surfaces 175 and feet 183 extend. The illumination cartridge 100 is approximately twice as thick in the transverse direction as a single cartridge 16. When assembled to the latch 14, the cartridge 100 occupies both positions B and C, and hence contact cartridges 16 cannot be provided in those positions. However, it is still possible, if desired, to provide contact cartridges 16 in positions A and D (on the ends) in the assembly of the illumination module 100 and latch 14.

Figure 17:
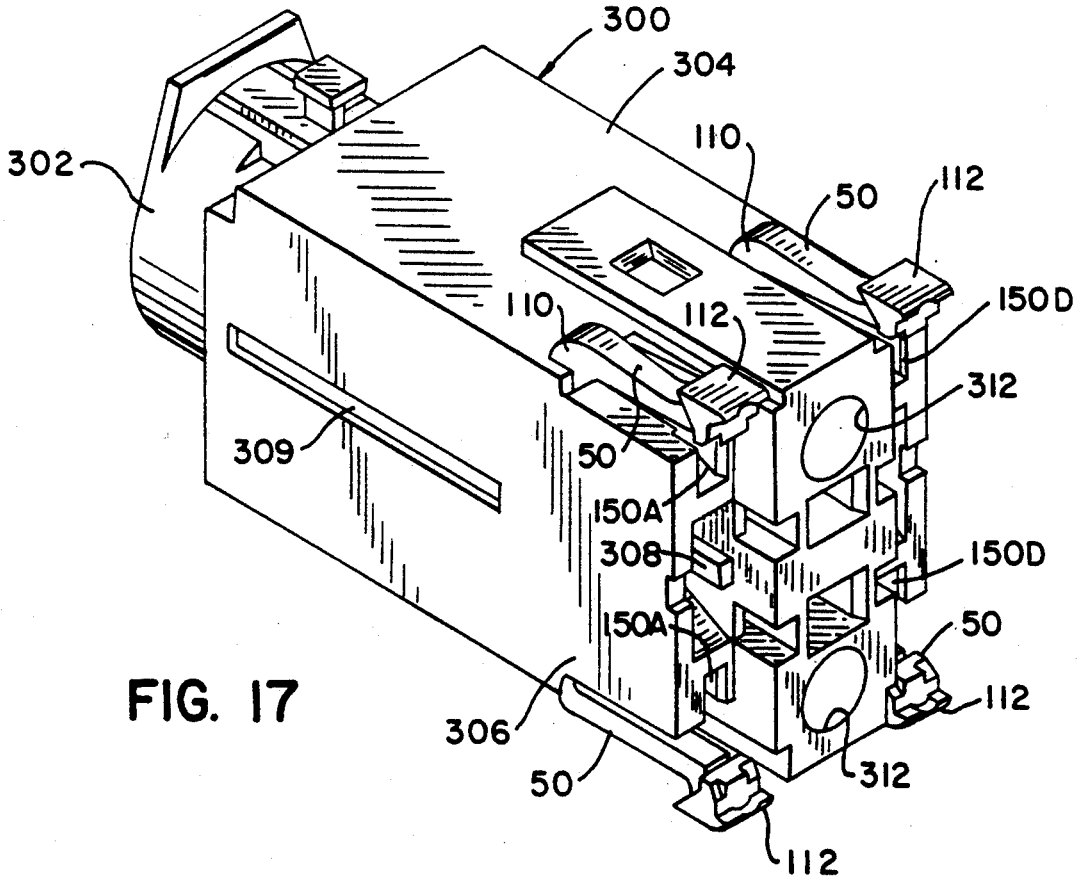
FIG. 17 is a perspective view of an alternate embodiment of a latch incorporating aspects of the invention.

FIG. 17 illustrates an alternate embodiment of a latch 300 incorporating aspects of the invention. The latch 300 shown in FIG. 17 has a barrel portion 302 which snaps onto the operator 12 in the same manner as the latch 14 described above, or which could be assembled to an operator in any other suitable manner. A relatively long body portion 304 resides between foundation 306 and the barrel portion 302. The body portion 304 in the latch 300 illustrated may house a transformer or other desired electrical device. A transformer may be useful, for example, if a light bulb and socket extends from the front of the latch 300, as in the cartridge 100, and the bulb required a stepped down voltage.

A push rod 308, only one of which is shown, is provided on each side of the latch 300 corresponding to the follower 70 positions in positions A and D, and extends through the latch 300 from one end to the other. The push rods 308 are guided in slots 309 and are freely reciprocable therein relative to the body 304 so that they can translate the motion of a push button operator to operate the follower 70 of a contact cartridge 16 as described above.

A pair of laterally opposed arms 50 are provided on the foundation 306 at positions A and D only and corresponding pockets 150A and 150D are provided in the foundation 306. Positions B and C between the pairs of arms 50 provided in the latch 300 are occupied by bores 312 for enabling making an electrical connection with the transformer or other electrical device held within the body 304.

The rearward ends of the push rods 308 are positioned to abut the forward end of the corresponding follower 70 with the contact cartridge 16 positioned behind the push rod 308. The forward end of each push end 308 (not shown) extends forwardly to and bears against one of the transverse projections 31 on the corresponding side of the operator 12. Thereby, the motion of the projections 31 are transferred to the followers 70.

The invention provides an operator/cartridge assembly which can be easily assembled by rocking or translating the cartridge relative to the latch, depending upon the assembler's preference. It provides a largely self guiding interface between the cartridge and the latch so as to facilitate assembly, and is exclusive; the cartridge in each position can only be assembled to the latch in the proper orientation. The invention also enables providing four identical cartridges in a single assembly, which are useable with an operator and latch that are compatible with an illumination cartridge. In addition, the latch and the interfacing cartridge components may be molded from relatively inexpensive plastic materials.

Preferred embodiments of an operator/cartridge assembly have been described. Numerous modifications and variations of the preferred embodiments will be apparent to those skilled in the art which will be within the spirit and scope of the invention. Therefore, the invention should not be limited by the scope of the foregoing description and drawings, but should be defined by the claims, which follow.

We claim:

1. An operator/cartridge assembly, comprising:

an operator operable by a user for actuating a cartridge for providing an interface between a user and a cartridge, said operator having a panel mounting portion adapted for mounting said operator to a panel, said operator defining mutually perpendicular longitudinal, lateral and transverse directions and extending in the longitudinal direction forwardly from said panel mounting portion to a front end and rearwardly from said panel mounting portion to a rear end;

a latch on said operator for securing said cartridge to said operator, said latch including:

a) a foundation for fixation to said operator, said foundation being adapted to be positioned on a rearward side of a panel to which said operator is mounted;

b) a pair of laterally opposed and spaced apart arms extending from a fixed end of said arms which is fixed to said foundation rearwardly along the longitudinal direction from said fixed end to a free end, said arms being resiliently movable toward and away from one another in the lateral direction;

c) the free end of each arm defining a locking surface, said locking surface including:

(i) a forwardly facing nose surface extending laterally outwardly from a laterally inner free edge to a laterally outer edge; and (ii) a forwardly facing cam surface coterminus with said nose surface and inclined outwardly from a laterally inner edge which intersects the laterally outer edge of the nose surface to a laterally outer edge; and a cartridge spanning said arms, said cartridge having a pair of laterally opposed outwardly extending lips, each said lip defining a rearwardly facing ledge surface for engagement with the locking surface on a corresponding lateral side of the latch;

wherein said lips are registrable with said locking surfaces forwardly of said nose surfaces and said cartridge is biased forwardly against the foundation by the lips camming on the cam surface.

2. An operator/cartridge assembly as in claim 1, wherein the free end of each arm has a pair of transversely spaced apart locking surfaces, the cartridge has opposed lateral sides and each lateral side of the cartridge has a pair of spaced apart lips, one of which engages each said locking surface.

3. An operator/cartridge assembly as in claim 2, wherein each arm extends inwardly from the cam surface in a space between the locking surfaces of each free end to be received in a space between the corresponding lips of the cartridge engaged by the arm.

4. An operator/cartridge assembly as in claim 3, wherein the foundation defines a rearwardly opening pocket forwardly of said nose surface and said cartridge has a foot forwardly of the ledge surfaces of the lips, said foot being received by said pocket.

5. An operator/cartridge assembly as in claim 4, wherein a foot is provided on each lateral side of the cartridge and a corresponding pocket is provided on each lateral side of the latch to receive each said foot.

6. An operator/cartridge assembly as in claim 4, wherein the foot is provided off center to one side of a transverse center plane of the cartridge, the pocket is so positioned in the foundation to receive said foot, the cartridge is a switch cartridge having a longitudinally extending reciprocable follower, and said follower is positioned off center from the transverse center plane of the cartridge.

7. An operator/cartridge assembly as in claim 1, wherein four pairs of laterally spaced apart arms are provided on the latch, and a cartridge is received between each said pair of arms.

8. An operator/cartridge assembly as in claim 7, wherein a pair of laterally spaced apart feet is provided on each cartridge to one side of a transverse center plane of the cartridge, the cartridge has a follower along said one side, and the foundation has four pairs of pockets to receiver the feet of said four cartridges.

9. An operator/cartridge assembly as in claim 1, wherein the free end of each arm has a rearwardly facing ramp surface which cams on the lip as the cartridge is engaged with the latch.

10. An operator/cartridge assembly as in claim 9, wherein two of said ramp surfaces are provided and are transversely spaced apart, and the arm extends inwardly toward the laterally opposite arm in the space between the two ramp surfaces.

11. An operator/cartridge assembly as in claim 1, wherein said latch further includes a body portion between the operator and the foundation, and a reciprocable push rod extends longitudinally through the body portion to operate a cartridge assembled to the latch with the operator.

12. An operator/cartridge assembly, comprising:

an operator operable by a user for actuating a cartridge for providing an interface between a user and a cartridge, said operator having a panel mounting portion adapted for mounting said operator to a panel, said operator defining mutually perpendicular longitudinal, lateral and transverse directions and extending in the longitudinal direction forwardly from said panel mounting portion to a front end and rearwardly from said panel mounting portion to a rear end;

a latch on said operator for securing said cartridge to said operator, said latch including:

a) a foundation including means for mounting said foundation to said operator on a rearward side of a panel to which said operator is mounted;

b) four pairs of laterally opposed and spaced apart arms, each said arm extending from a fixed end of said arm which is fixed to said foundation rearwardly along the longitudinal direction from said fixed end to a free end, said arms of each pair being resiliently movable toward and away from one another in the lateral direction;

c) the free end of each said arm defining a pair of spaced apart locking surfaces, each said locking surface including:

(i) a forwardly facing nose surface extending laterally outwardly from a laterally inner free edge to a laterally outer edge; and (ii) a forwardly facing cam surface coterminus with said nose surface and inclined outwardly from a laterally inner edge which intersects the laterally outer edge of the nose surface to a laterally outer edge; and four cartridges, each of said cartridges spanning a pair of arms and having two pairs of laterally opposed outwardly extending lips, the lips of each pair being transversely spaced apart from the lips of the other pair defining a transverse space between said pairs of receiving a corresponding arm, each said lip defining a rearwardly facing ledge surface for engagement with the corresponding locking surface on the free end of the corresponding arm;

wherein said lips are registrable with said locking surfaces forwardly of said nose surfaces and said cartridge is biased forwardly against the foundation by the lips camming on the cam surface.

13. An operator/cartridge assembly as in claim 12, wherein a pair of laterally spaced apart feet is provided on each cartridge to one side of a transverse center plane of the cartridge, the cartridge has a longitudinally reciprocable follower operable by said operator to one side of the transverse center plane of the cartridge, and the foundation has four pairs of pockets to receive the feet of said four cartridges.

14. An operator/cartridge assembly as in claim 13, wherein the follower and the feet are on the same side of the transverse center of the cartridge.

15. An operator/cartridge assembly as in claim 13, wherein the free end of each arm has a pair of transversely spaced apart rearwardly facing ramp surfaces which cam on the lips as the lips are engaged with the free end, and the arm extends inwardly toward the laterally opposite arm in a space between the two ramp surfaces.

16. An operator/cartridge assembly, comprising:

an operator operable by a user for actuating a cartridge for providing an interface between a user and a cartridge, said operator having a panel mounting portion adapted or mounting said operator to a panel, said operator defining mutually perpendicular longitudinal, lateral and transverse directions and extending in the longitudinal direction forwardly from said panel mounting portion to a front end and rearwardly from said panel mounting portion to a rear end;

a latch on said operator for securing said cartridge to said operator said latch including:

a) a foundation for fixation to said operator, said foundation being adapted to be positioned on a rearward side of a panel to which said operator is mounted;

b) four pairs of arms, the arms of each pair being laterally opposed and spaced apart, each said arm extending rearwardly from a fixed end of said arm which is fixed to said foundation to a free end of said arm, the arms of each pair being resiliently movable toward and away from one another in the lateral direction;

c) the free end of each arm defining a locking surface for engaging one lateral side of a corresponding cartridge;

four cartridges for mounting to said foundation in operative relationship to said operator, each of said cartridges having a pair of laterally opposed lips for engagement with the locking surfaces of a corresponding pair of arms;

wherein the lips of said four cartridges are registrable with the locking surfaces of said four pairs of arms with each of said cartridges engaged by a corresponding pair of arms so as to mount said four cartridges on said foundation in operative relationship to said operator.

* * * * *